US005480281A

United States Patent [19]

Correia

[11] Patent Number: 5,480,281

[45] Date of Patent: Jan. 2, 1996

[54] IMPINGEMENT COOLING APPARATUS FOR TURBINE SHROUDS HAVING DUCTS OF INCREASING CROSS-SECTIONAL AREA IN THE DIRECTION OF POST-IMPINGEMENT COOLING FLOW

[75] Inventor: Victor H. S. Correia, Scotia, N.Y.

[73] Assignee: General Electric Co., Schenectady, N.Y.

[21] Appl. No.: 269,289

[22] Filed: Jun. 30, 1994

[51] Int. Cl.[6] ..... F01D 9/02; F01D 25/12

[52] U.S. Cl. ..... 415/115

[58] Field of Search ..... 415/115, 116

[56] References Cited

U.S. PATENT DOCUMENTS

| | | | |
|---|---|---|---|
| 4,017,207 | 4/1977 | Bell et al. | 415/115 |
| 4,379,677 | 4/1983 | Hallinger et al. | 415/115 |
| 4,573,865 | 3/1986 | Hsia et al. | 415/115 |
| 4,721,433 | 1/1988 | Piendel et al. | 415/115 X |
| 4,826,397 | 5/1989 | Shook et al. | 415/115 |
| 5,100,291 | 3/1992 | Glover | 415/115 |
| 5,116,199 | 5/1992 | Ciokajlo | 415/115 |
| 5,205,115 | 4/1993 | Plemmons et al. | 415/115 |
| 5,219,268 | 6/1993 | Johnson | 415/115 |
| 5,363,654 | 11/1994 | Lee | 415/115 |
| 5,391,052 | 2/1995 | Correia et al. | 415/115 |

*Primary Examiner*—Edward K. Look
*Assistant Examiner*—Michael S. Lee
*Attorney, Agent, or Firm*—Nixon & Vanderhye

[57] ABSTRACT

A turbine shroud includes a plurality of cavities for receiving cooling steam for flow through the cavities in series counterflow to the direction of the hot gases of combustion. In the first cavity, a projection forms a nozzle to increase the velocity of the cooling steam to increase the convection coefficient for cooling the wall of the shroud. The steam flow in the second cavity passes through an impingement plate for impingement cooling of the wall of the shroud. Likewise, steam passes from the second cavity into the third cavity for flow through an impingement plate for further impingement cooling of the wall of the shroud. In the second and third cavities, the impingement plates include a plurality of ducts affording increased flow area in the direction of travel of the post-impingement steam flow to reduce cross-flow effects.

15 Claims, 3 Drawing Sheets

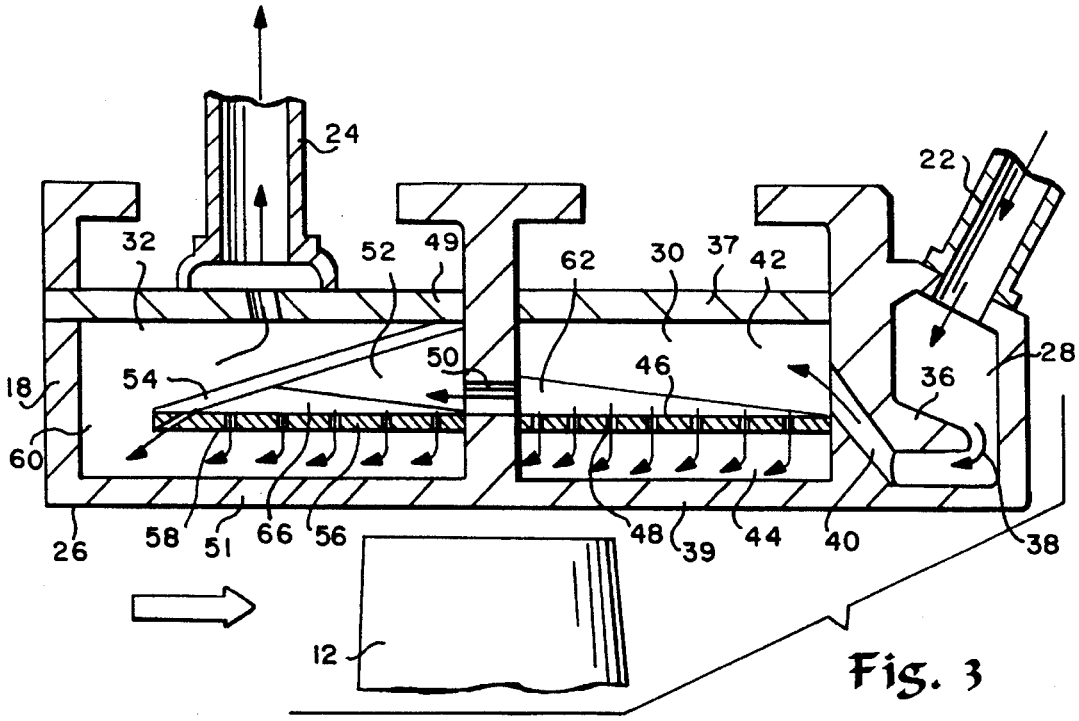
Fig. 3
Fig. 4
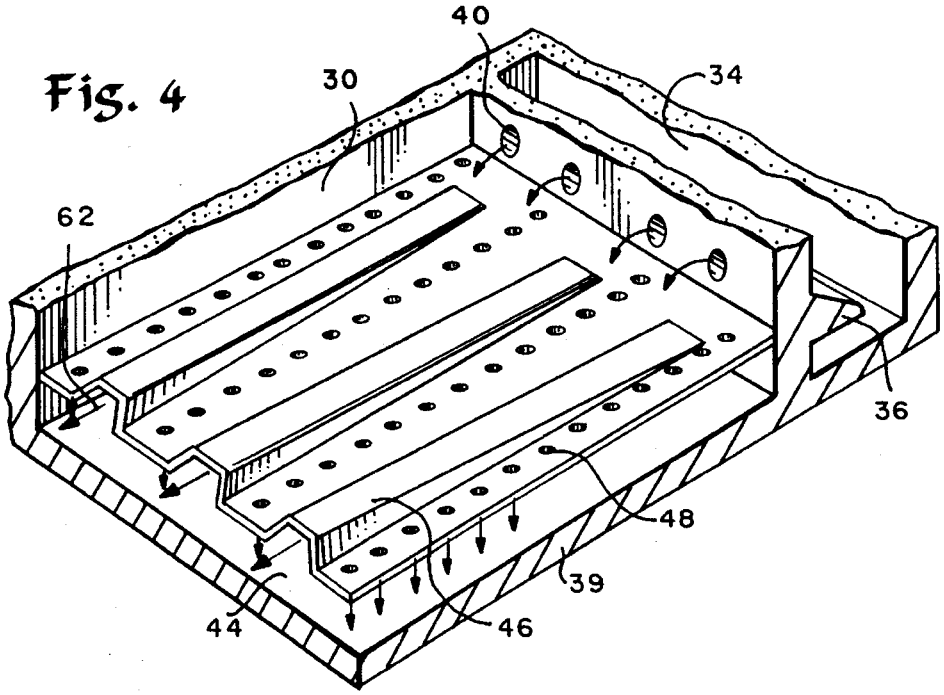

IMPINGEMENT COOLING APPARATUS FOR TURBINE SHROUDS HAVING DUCTS OF INCREASING CROSS-SECTIONAL AREA IN THE DIRECTION OF POST-IMPINGEMENT COOLING FLOW

TECHNICAL FIELD

The present invention relates to apparatus for cooling turbine shrouds and particularly to apparatus for impingement cooling of turbine shrouds with reduction in cross-flow effects, as well as a system for flowing in series a cooling medium through several cooling cavities of a turbine shroud in a single flow circuit.

BACKGROUND

A current method for cooling turbine shrouds employs an air impingement plate which has a multiplicity of holes for flowing air through the impingement plate at relatively high velocity due to a pressure difference across the plate. The high velocity air flow through the holes strikes and impinges on the component to be cooled. After striking and cooling the component, the post-impingement air finds its way to the lowest pressure sink. However, as this spent cooling air travels to the sink, the accumulating spent air crosses the paths of other high-velocity jets of air which are directed to impinge on the component to be cooled. The spent cooling air thus accumulates in a downstream direction toward the low-pressure sink. This cross-flow of the spent air interacts with the high-velocity incoming impingement-cooling air to significantly degrade the effectiveness of the impingement cooling air as it crosses from the impingement plate to the component to be cooled. This degrading effect becomes more significant in the downstream areas of increased mass flow.

In prior U.S. Pat. No. 5,391,052 issued Feb. 21, 1995 and of common assignee herewith, there is provided apparatus and methods for impingement cooling of turbine components, particularly a turbine shroud, using steam as the cooling medium. While the apparatus and methods disclosed in that application afford effective steam cooling of turbine shrouds, there is constant need for improving the steam turbine cooling with a minimum amount of cooling media and further reductions in the detrimental cross-flow effects.

DISCLOSURE OF THE INVENTION

In accordance with the present invention, there is provided a system for maximizing the efficiency of the cooling effect in a series cooling flow circuit, as well as apparatus for minimizing cross-flow effects. Turning first to the system, there is provided a plurality of cavities in a turbine shroud, i.e., a fixed shroud, radially outwardly of the tips of the turbine bucket, for passing a cooling medium, for example, steam, in a direction counterflow to the direction of the hot gas path through the turbine. It will be appreciated that at least one wall surface of the shroud is exposed to the hot gases of combustion passing through the turbine. By serially cooling the cavities in a counterflow direction, an orderly controlled flow is provided. Additionally, less steam is used to cool the same area and preheating of the relatively low temperature areas where the flow conditions are less severe is provided. Also, once the steam reaches cavities where the flowpath conditions are more severe, the steam has already been heated sufficiently to afford an effective cooling of that area but is not too cold to impart a high thermal gradient through the part which would otherwise result in high stresses.

More particularly, the cooling steam enters the shroud into a first cavity having a reduced area forming a nozzle causing an increase in steam velocity as the steam travels downstream. This increase in velocity increases the convection coefficient along the wall of the shroud to be cooled in the first cavity, thus cooling the region and subsequently increasing the temperature of the steam. After cooling the shroud wall in the first cavity, the steam passes through exhaust passages at high velocity into a second cavity. In this second cavity, an impingement plate divides the cavity into first and second chambers. The steam thus passes from the first chamber through holes in the impingement plate which form high-velocity steam jets and into the second chamber with the steam jet impacting the wall of the second cavity to be cooled, simultaneously increasing the temperature of the steam after the cooling has been effected. Steam flows through reduced exhaust openings from the second cavity and, hence, at a high velocity into the third cavity, also having an impingement plate. In the third cavity, however, an enclosure plate defines, with the impingement plate, a further cavity which forces the steam to pass through the holes in the impingement plate for direct impact on the wall to be cooled in the third cavity. The steam then passes about the enclosure plate into a collection manifold in communication with an exhaust pipe.

In accordance with another aspect of the present invention, impingement cooling cross-flow effects are minimized or reduced. To accomplish this, one or more ducts are formed in each of the impingement plates between the rows of cooling holes, the latter being arranged generally parallel to the direction of the flow of post-impingement steam toward its exit from the cavity. Preferably, the height of the duct increases in the downstream flow direction. The ducts accordingly provide increased area for the spent steam flow to travel as its mass flow increases with downstream position. The added area tends to reduce the cross-flow effects because a lesser magnitude of spent flow occurs between the impingement holes and the walls to be cooled and which spent flow might otherwise interfere with the high velocity jets of cooling steam impacting the surfaces to be cooled.

In a preferred embodiment according to the present invention, there is provided an impingement steam cooling apparatus for turbines comprising a turbine shroud having first and second walls spaced from one another and an impingement plate spaced between the walls to define on opposite sides of the impingement plate first and second chambers substantially sealed from one another, the impingement plate having a plurality of flow openings therethrough for communicating cooling steam between the chambers through the openings and a supply passage in communication with the first chamber for supplying cooling steam into the first chamber for flow through the openings into the second chamber and impingement cooling of the second wall. An exhaust opening is provided in communication with the second chamber for exhausting post-impingement cooling steam flowing from the second chamber and at least one duct is formed in the impingement plate in communication with the second chamber to provide increased flow area for at least part of the post-impingement steam as the mass flow thereof increases in a downstream direction toward the exhaust opening.

In a further preferred embodiment according to the present invention, there is provided a system for cooling a turbine shroud comprising plural cavities, a first cavity of the plural cavities having an inlet for receiving cooling steam and a steam outlet passage, the first cavity defining a nozzle for increasing the velocity of steam flowing through the first cavity to the outlet passage. A second cavity of the plurality of cavities is provided having first and second walls spaced from one another and an impingement plate spaced between the walls to define on opposite sides of the impingement plate first and second chambers substantially sealed from one another, the first chamber lying in communication with the outlet passage for receiving steam from the first cavity, the impingement plate having a plurality of flow openings therethrough for communicating cooling steam from the first chamber through the openings into the second chamber for impingement cooling of the second wall of the second cavity. An exhaust opening is in communication with the second chamber for exhausting post-impingement cooling steam flowing from the second chamber and a duct forming part of the second cavity is in communication with the flow of post-impingement steam from the second chamber toward the exhaust opening, affording increased flow area for at least part of the post-impingement steam as the mass flow thereof increases in a downstream direction toward the exhaust opening for reducing cross-flow effects within the second chamber.

In a still further preferred embodiment according to the present invention, there is provided a method of cooling a turbine shroud by steam impingement of the shroud comprising the steps of flowing cooling steam into a cavity within the shroud, flowing cooling steam from the first chamber through a plurality of openings disposed in an impingement plate dividing the cavity into a first chamber and a second chamber, directing the steam flowing through the openings across the second chamber for impingement against a wall of the shroud to cool the wall, flowing post-impingement cooling steam in the second chamber to an exhaust opening and forming at least one duct in the cavity to provide an increased flow area for the post-impingement cooling steam in the second chamber to reduce cross-flow effects by reducing the post-impingement flow of the steam between the impingement openings and the wall.

Accordingly, it is a primary object of the present invention to provide novel and improved apparatus and methods for cooling turbine shrouds with greater cooling efficiency and reduced cross-flow effects during impingement cooling.

BRIEF DESCRIPTION OF THE DRAWINGS

FIG. 3 is an enlarged cross-sectional view of the cooling cavities formed by the shroud illustrated in FIGS. 1 and 2; and FIG. 4 is a fragmentary perspective view of an impingement plate in the second cavity illustrated in FIG. 2.

BEST MODE FOR CARRYING OUT THE INVENTION

Figure 1:
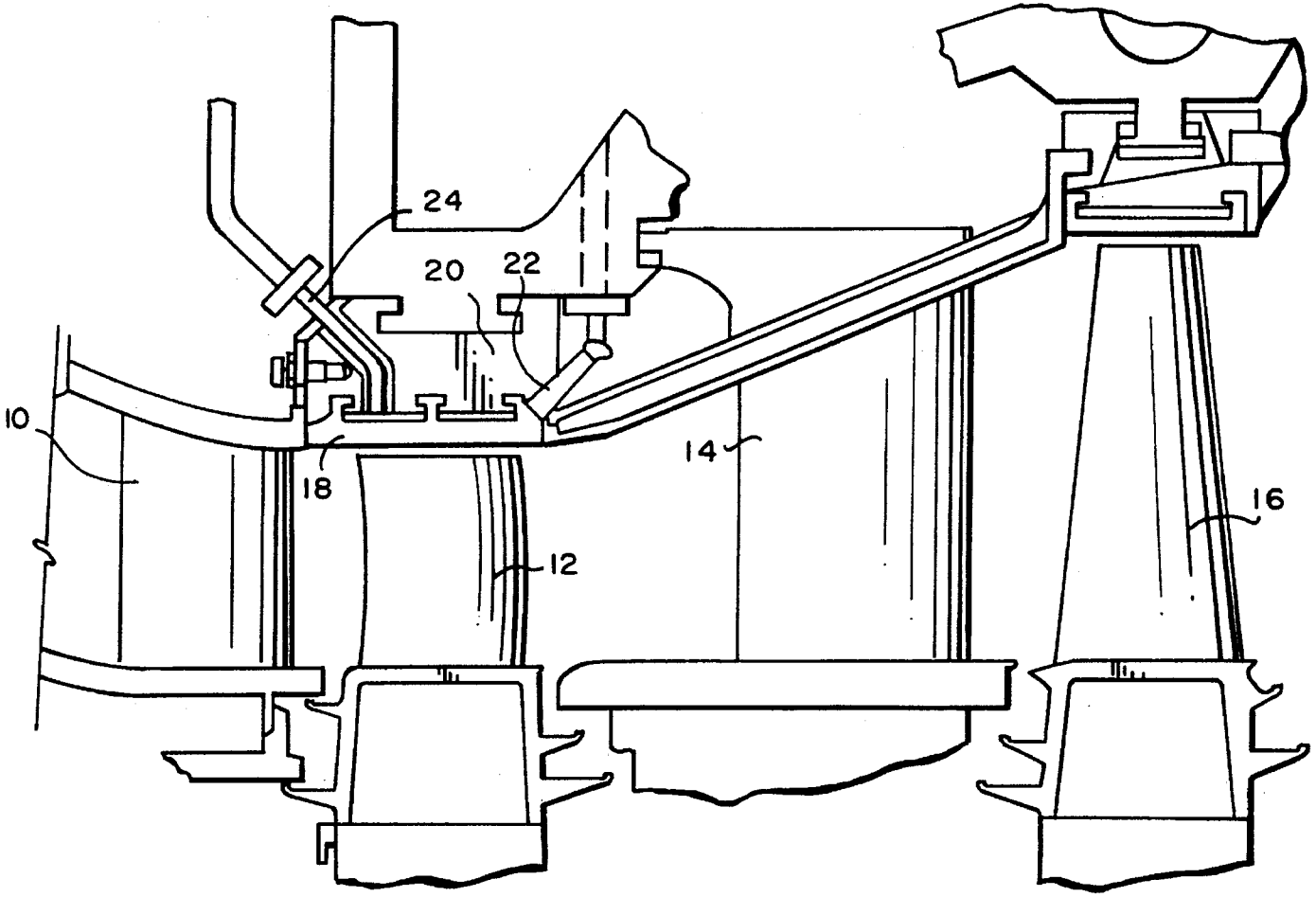
FIG. 1 is a schematic elevational view of a portion of a turbine inner shell illustrating the location of the turbine shroud about the buckets of the turbine.
Figure 2:
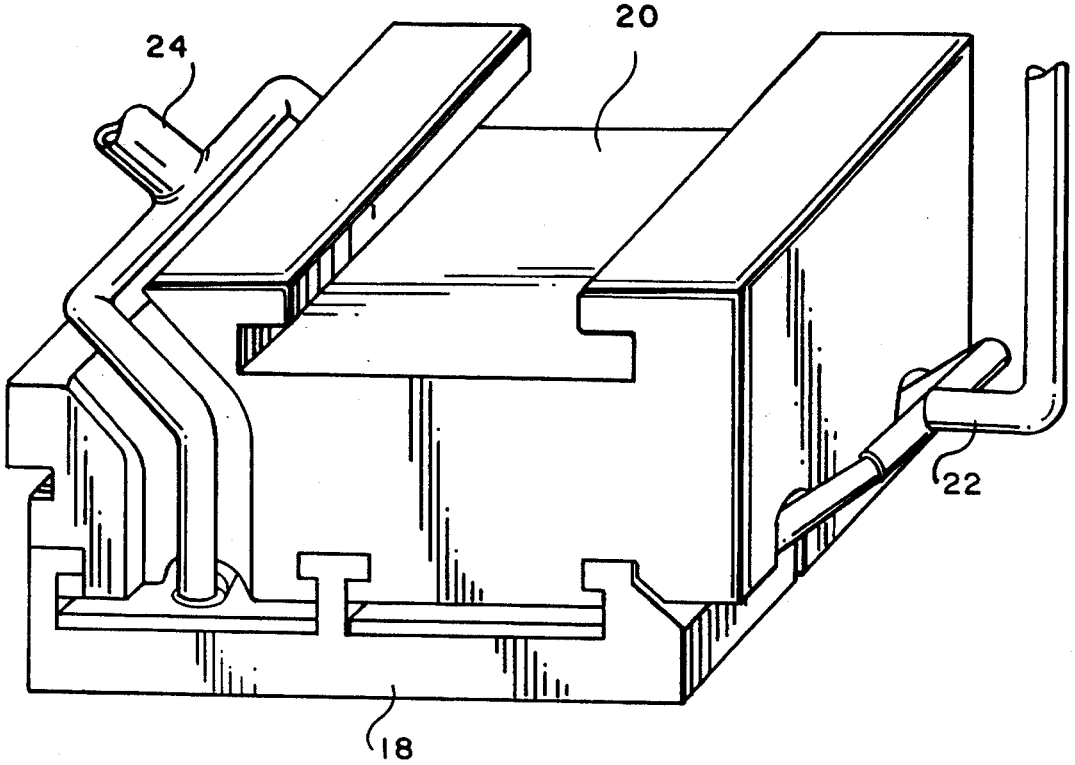
FIG. 2 is an enlarged perspective view of the cooling shroud of FIG. 1 as secured to a shroud hanger.

Referring now to FIG. 1, there is illustrated a layout for the inner shell of a turbine, including a first-stage nozzle 10, a first-stage bucket 12, a second-stage nozzle 14 and a second-stage bucket 16. It will be appreciated that the first and second-stage buckets 12 and 16 rotate about the axis of the shaft of the turbine, not shown, while the first and second-stage nozzles 10 and 14 are stationary and secured to the inner shell of the turbine. The present invention relates to a turbine shroud 18 secured to a shroud hanger 20 and forming part of the stationary inner shell, the inner shroud wall being spaced from the outer tip of the bucket in the first stage of buckets. The inner shell includes a cooling steam inlet supply passage 22 and a post-impingement cooling steam exhaust passage 24, both in communication with the shroud 18. The shroud hanger assembly is illustrated in FIG. 2, together with the steam supply and exhaust passages 22 and 24, respectively.

Referring now to FIGS. 3 and 4, it will be seen that the hot gas path for flowing the hot gases of combustion is in the direction of the arrow in FIG. 3, thus passing the inner surface 26 of the shroud 18. The shroud is formed of three substantially closed cavities 28, 30 and 32. As illustrated, cavity 28 receives steam from the steam supply passage 22 for flow into the second cavity 30. As explained hereafter, the cooling steam in cavity 30 passes through an impingement plate for impingement cooling of a portion of the wall surface 26 for subsequent flow through an exhaust passage into the third cavity 32. Impingement cooling is likewise provided the wall portion 26 in the third cavity, with the steam ultimately exiting the shroud through the steam exhaust 24.

Particularly referring now to FIGS. 3 and 4, the first cavity 28 comprises a manifold 34, a wall of which has a projection 36 which forms a nozzle 38 for reducing the flow area. The nozzle 38 causes the steam to increase in velocity as it travels downstream in cavity 28 for exhaust through a plurality of spaced passages 40. By forcing the steam around the projection 36 and through the nozzle formed thereby, the steam increases in velocity, with consequent increase in the convection coefficient along the lower surface of cavity 28 exposed to the hot gas path. Thus, the hot gas path is cooled in that region and the cooling steam is increased in temperature as the cooling steam flows through the exhaust passages 40 into the second cavity 30.

In cavity 30, which is defined between first and second walls 37, 39, respectively, the heated cooling steam from first cavity 28 flows into a first chamber 42. Cavity 30 is divided into a first chamber 42 and a second chamber 44 by an impingement plate 46. Impingement plate 46 has a plurality of openings 48 for passing the cooling steam at high velocity from first chamber 42 into the second chamber 44 for steam impact on wall 39 of the second chamber thus affording impingement cooling of that wall. The temperature of the steam, of course, is increased as cooling is effected. The post-impingement steam passes through an exhaust opening 50 formed between cavities 30 and 32.

In cavity 32, which is defined between third and fourth walls 49, 51, respectively, the cooling steam enters into a third chamber 52 defined between a closure plate 54 and a second impingement plate 56. The second impingement plate 56 includes a plurality of flow openings 58 for flowing cooling steam at high velocity for impact against wall 51 of cavity 32 whereby that wall is impingement cooled. The post-impingement steam flows around the third chamber 52 and from the fourth chamber 60 into the exhaust passage 24.

It will thus be appreciated that the cooling steam flows through a plurality of cavities in serial fashion counterflow to the flow of hot gases of combustion. Thus, as the flow path conditions become more severe, the cooling steam is at an increased temperature which effectively cools the hot gas surfaces but also reduces the thermal gradient between the cooling steam and the hot gases to preclude high stresses in the cooled surfaces.

Referring now to FIG. 4, the impingement plate 46 in the second cavity 30 is illustrated. Impingement plate 46 includes at least one, and preferably a plurality of ducts 62 in open communication with the second chamber 44 between the impingement plate 46 and the wall 39 to be cooled. Preferably, the openings 48 are arranged in rows extending in the flow direction of the post-impingement steam flowing toward the exhaust openings 50 from cavity 30. The ducts are thus arranged between the rows of openings 48 and open in increasing area in the direction of the flow of the post-impingement cooling steam. Consequently, as illustrated in FIG. 4, the ducts 62 increase in cross-sectional area in a direction toward exhaust openings 50 whereby the cross-sectional area of the second chamber 44 likewise increases in the direction of post-impingement cooling flow. Stated differently, the height of the ducts 62 increases as the ducts approach the downstream end of the plate. Accordingly, the ducts 62 provide increased area for the spent cooling steam flow to travel as the mass flow of the post-impingement cooling steam increases in downstream position. This added area for the flow of post-impingement steam tends to reduce the cross-flow effects because less spent cooling steam is travelling between the impingement openings and the floor of the shroud.

Referring to FIG. 3, the second impingement plate 56 of the third cavity 32 is similarly shaped as the impingement plate 46 of the second cavity 30. That is, the impingement plate 56 similarly includes a plurality of ducts 66 which open into the fourth chamber 60 to provide increasing post-impingement steam cooling flow area in a direction toward the exhaust 24.

While the invention has been described in connection with what is presently considered to be the most practical and preferred embodiment, it is to be understood that the invention is not to be limited to the disclosed embodiment but, on the contrary, is intended to cover various modifications and equivalent arrangements included within the spirit and scope of the appended claims. For example, though the preferred embodiment utilizes steam as the cooling fluid, it may be acceptable in lower temperature applications to use other fluids such as air which, in gas turbine applications, is typically bled from the compressor in a manner well known in the art.

What is claimed is:

1. Impingement steam cooling apparatus for turbines comprising:

a turbine shroud having first and second walls spaced from one another and an impingement plate spaced between said walls to define on opposite sides of said impingement plate first and second chambers substantially sealed from one another, said impingement plate having a plurality of flow openings therethrough for communicating cooling steam between said chambers through said openings;

a supply passage in communication with said first chamber for supplying cooling steam into said first chamber for flow through said openings into said second chamber and impingement cooling of said second wall;

an exhaust opening in communication with said second chamber for exhausting post-impingement cooling steam flowing from said second chamber; and at least one duct formed in said impingement plate in communication with said second chamber to provide increased flow area for at least part of the post-impingement steam as the mass flow thereof increases in a downstream direction toward said exhaust opening.

2. Apparatus according to claim 1 wherein the flow openings through said impingement plate are aligned in rows generally parallel to the direction of flow of the post-impingement steam along said second chamber toward said exhaust passage, said duct being disposed between rows of said openings.

3. Apparatus according to claim I wherein said duct increases in cross-sectional area in a downstream direction of the flow of the post-impingement steam toward said exhaust opening.

4. Apparatus according to claim I including a plurality of ducts including said one duct formed in said impingement plate in communication with said second chamber to provide increased flow area for at least part of the post-impingement steam as the mass flow thereof increases in a downstream direction toward said exhaust opening.

5. Apparatus according to claim 1 wherein said duct comprises a channel formed in said impingement plate and projecting to one side of said impingement plate toward said first wall.

6. Apparatus according to claim 5 wherein said channel increases in cross-sectional area in a downstream direction of the flow of the post-impingement steam toward said exhaust opening.

7. Apparatus according to claim I wherein said supply passage includes an entrance cavity defining a nozzle for flowing cooling steam at increased velocity into said first chamber.

8. A system for cooling a turbine shroud comprising:

a shroud housing defining plural cavities;

a first cavity of said plural cavities having an inlet for receiving cooling steam and a steam exhaust passage, said first cavity defining a nozzle for increasing the velocity of steam flowing through said first cavity to said exhaust passage;

a second cavity of said plurality of cavities having first and second walls spaced from one another and an impingement plate spaced between said walls to define on opposite sides of said impingement plate first and second chambers substantially sealed from one another;

said first chamber lying in communication with said exhaust passage for receiving steam from said first cavity, said impingement plate having a plurality of flow openings therethrough for communicating cooling steam from said first chamber through said openings into said second chamber for impingement cooling of said second wall of said second cavity;

an exhaust opening in communication with said second chamber for exhausting post-impingement cooling steam flowing from said second chamber; and a duct forming part of said second cavity in communication with the flow of post-impingement steam from said second chamber toward said exhaust opening, affording increased flow area for at least part of the post-impingement steam as the mass flow thereof increases in a downstream direction toward said exhaust opening for reducing cross-flow effects within said second chamber.

9. A system according to claim 8 wherein said duct increases in cross-sectional area in a downstream direction of the flow of the post-impingement steam toward said exhaust opening.

10. A system according to claim 8 including a plurality of ducts including said one duct formed in said impingement plate in communication with the flow of post-impingement steam flow in said second chamber to provide increased flow area for at least part of the post-impingement steam as the mass flow thereof increases in a downstream direction toward said exhaust opening.

11. A system according to claim 8 wherein said duct comprises a channel formed in said impingement plate and projecting to one side of said impingement plate toward said first wall.

12. A system according to claim 11 wherein said channel increases in cross-sectional area in a downstream direction of the flow of the post-impingement steam toward said exhaust passage.

13. A system according to claim 8 including a third cavity of said plurality thereof having third and fourth walls spaced from one another and a second impingement plate spaced between said walls to define on opposite sides of said second impingement plate third and fourth chambers substantially sealed from one another, said third chamber lying in communication with said exhaust opening of said second chamber for receiving the post-impingement steam from said second cavity;

said second impingement plate having a plurality of flow openings therethrough for communicating cooling steam from said third chamber through said openings into said fourth chamber for impingement cooling of said fourth wall of said third cavity;

an exhaust passage in communication with said fourth chamber for exhausting post-impingement cooling steam flow from said fourth chamber; and a duct forming part of said third cavity in communication with said fourth chamber affording increased flow area for at least part of the post-impingement steam flowing along said fourth chamber as the mass flow thereof increases in a downstream direction toward said exhaust passage for reducing cross-flow effects within said fourth chamber.

14. A method of cooling a turbine shroud by steam impingement comprising the steps of:

flowing cooling steam into a cavity within the shroud;

flowing cooling steam from said cavity through a plurality of openings disposed in an impingement plate dividing the cavity into a first chamber and a second chamber;

directing the steam flowing through said openings across said second chamber for impingement against a wall of the shroud to cool said wall;

flowing post-impingement cooling steam in said second chamber to an exhaust opening; and forming at least one duct in the cavity to provide an increased flow area for the post-impingement cooling steam in said second chamber to reduce cross-flow effects by reducing the post-impingement flow of said steam between the impingement openings and the wall.

15. A method according to claim 14 including providing another flow cavity in said shroud with a flow nozzle, flowing cooling steam first into said other cavity and through said nozzle to increase the velocity of steam flow and the convection coefficient along the shroud, and exhausting the cooling steam from said other cavity into said first chamber.

* * * * *